US009318238B2

(12) United States Patent
Yamaguchi et al.

(10) Patent No.: US 9,318,238 B2
(45) Date of Patent: Apr. 19, 2016

(54) HOLLOW CORE BODY FOR SIGNAL TRANSMISSION CABLE

(75) Inventors: Tadashi Yamaguchi, Nagano (JP); Shigehiro Sasai, Nagano (JP)

(73) Assignee: Totoku Electric Co., Ltd., Tokyo (JP)

( * ) Notice: Subject to any disclaimer, the term of this patent is extended or adjusted under 35 U.S.C. 154(b) by 0 days.

(21) Appl. No.: 14/345,053

(22) PCT Filed: Oct. 4, 2011

(86) PCT No.: PCT/JP2011/072816

§ 371 (c)(1), (2), (4) Date: Mar. 14, 2014

(87) PCT Pub. No.: WO2013/051096

PCT Pub. Date: Apr. 11, 2013

(65) Prior Publication Data

US 2015/0075840 A1 Mar. 19, 2015

(51) Int. Cl.

| | |
|---|---|
| ***H01B 7/04*** | (2006.01) |
| ***H01B 11/00*** | (2006.01) |
| *H01B 11/18* | (2006.01) |
| *H01B 13/00* | (2006.01) |

(52) U.S. Cl.

CPC ..... *H01B 7/04* (2013.01); *H01B 11/00* (2013.01); *H01B 11/1856* (2013.01); *H01B 11/1808* (2013.01); *H01B 13/0006* (2013.01)

(58) Field of Classification Search

CPC ..... H01B 11/1856; H01B 11/00; H01B 7/04; H01B 7/0208; H01B 7/0216; H01B 7/0275; H01B 7/0284

USPC ..... 174/114 S, 113 A, 128.2

See application file for complete search history.

(56) References Cited

U.S. PATENT DOCUMENTS

| | | | | |
|---|---|---|---|---|
| 5,449,861 | A * | 9/1995 | Fujino et al. | 174/113 A |
| 2005/0230145 | A1 * | 10/2005 | Ishii et al. | 174/113 AS |
| 2006/0011378 | A1 * | 1/2006 | Maeda | 174/128.1 |
| 2011/0056724 | A1 * | 3/2011 | Tanaka et al. | 174/102 R |

FOREIGN PATENT DOCUMENTS

| | | | | |
|---|---|---|---|---|
| JP | 8-203347 | | 8/1996 | |
| JP | 08203347 | A * | 8/1996 | H01B 11/00 |
| JP | 2006-032081 | | 2/2006 | |
| JP | 2007-059123 | | 3/2007 | |
| JP | 2009-037911 | | 2/2009 | |
| JP | 2010-198873 | | 9/2010 | |
| JP | 2010-287410 | | 12/2010 | |
| JP | 2011-023205 | | 2/2011 | |
| WO | WO-2011/007635 | | 1/2011 | |
| WO | WO 2011007635 | A1 * | 1/2011 | |

* cited by examiner

*Primary Examiner* — Hoa C Nguyen
*Assistant Examiner* — Amol Patel
(74) *Attorney, Agent, or Firm* — Jordan and Hamburg LLP

(57) ABSTRACT

A hollow core body for signal transmission cable comprises an inner conductor that employs a compressed bunched conductor formed by bunching and compressing plural strands such that a cross-section of the compressed bunched conductor is substantially circular, and a hollow insulating core that includes an inner annular member, rib members, an outer annular member, and hollow members. Accordingly, as almost no recesses are produced on the circumferential surface of the compressed bunched conductor, weakening of the mechanical strength due to presence of recesses on the circumferential surface of the inner conductor can be suppressed.

6 Claims, 6 Drawing Sheets

HOLLOW CORE BODY FOR SIGNAL TRANSMISSION CABLE

TECHNICAL FIELD

The present invention relates to a hollow core body for signal transmission cable. More particularly, the present invention relates to a hollow core body for signal transmission cable in which weakening of its mechanical strength due to presence of recesses on a circumferential surface of its inner conductor comprised of a bunched conductor is suppressed.

BACKGROUND OF THE INVENTION

A hollow core body for signal transmission cable 600 shown in FIG. 5 is known in the art (See, for example, Patent Documents 1 and 2). This hollow core body for signal transmission cable 600 includes an inner conductor 16 and a hollow insulating core 60. The inner conductor 16 includes a twisted conductor formed by bunching and twisting plural strands 6, 6, . . . . The hollow insulating core 60 includes an inner annular member 61 that surrounds the inner conductor 16, plural rib members 62 that radially extend from the inner annular member 61, an outer annular member 63 that couples outer ends of the rib members 62, and plural hollow members 64 that are enclosed by the inner annular member 61, the rib members 62, and, the outer annular member 63.

PRIOR ART DOCUMENTS

Patent Document 1: Japanese Patent Application Laid-open No. 2011-23205

Patent Document 1: Japanese Patent Application Laid-open No. 2010-287410

SUMMARY OF THE INVENTION

In order to achieve flexibility and bending property required for a signal transmission cable, the conventional hollow core body for signal transmission cable 600 employs twisted strands, instead of a single strand, for the inner conductor 16.

However, valleys are produced between adjacent strands 6, 6, . . . on the circumference of the inner conductor 16 and appear as recesses 66, 66, . . . . Therefore, when forming the hollow insulating core 60 around the inner conductor 16 by extrusion molding, the resin does not enter in a desired manner in the recesses 66, 66, . . . thereby producing spaces. The mechanical strength becomes weak in a portion where the rib members 62, 62, . . . are present right above the recesses 66, 66, . . . (as the inner conductor 16 is a twisted conductor, such portions are present inevitably) where there are such spaces. Accordingly, as shown in FIG. 6, the hollow core body for signal transmission cable 600 tends to easily deform when a lateral pressure P is applied. Moreover, as the thickness of the inner annular member 61 becomes uneven, its outer cross-sectional shape tends to easily crumble from a circle. Accordingly, an outer cross-sectional shape of the outer annular member 63 also tends to easily crumble from a circle, making the mechanical strength of the entire structure weak. In view of the above discussion, it is an object of the present invention to provide a hollow core body for signal transmission cable in which weakening of its mechanical strength due to presence of recesses on a circumferential surface of its inner conductor comprised of a bunched conductor is suppressed.

According to a first aspect of the present invention, a hollow core body for signal transmission cable (100 to 300) includes an inner conductor (11, 12, 13) that employs a bunched conductor formed by bunching plural strands; and a hollow insulating core (20) that includes as inner annular member (21) that surrounds the inner conductor (11, 12, 13), plural rib members (22) that radially extend from the inner annular member (21), an outer annular member (23) that couples outer ends of the rib members (22), and plural hollow members (24) chat are enclosed by the inner annular member (21), the rib members (22), and the outer annular member (23). The inner conductor (11, 12, 13) is a compressed bunched conductor formed by bunching plural strands (1, 2, 3) and compressing the bunched strands (1, 2, 3) such that a cross-section of the compressed assembly is substantially circular or substantially polygonal having a number of angles of the compressed assembly the same as or larger than a number of the rib members (22).

In the hollow core body for signal transmission cable (100 to 300) according to the first aspect, the compressed bunched conductor is used as the inner conductor (11, 12, 13), and the compressed bunched conductor is formed by bunching plural strands (1, 2, 3) and compressing the bunched strands (1, 2, 3) such that a cross-section of the compressed assembly is substantially circular or substantially polygonal. Accordingly, as almost no recesses are produced on the circumferential surface of the compressed bunched conductor, weakening of the mechanical strength due to presence of recesses on the circumferential surface of the inner conductor (11, 12, 13) can be suppressed. Moreover, as evenness of the thickness of the inner annular member (21) improves, the outer shape of the inner annular member (21) does not easily deform from a circle, so that the shape of the outer surface of the outer annular member (63) also does not easily deform from a circle. Even this fact contributes to suppressing weakening of the mechanical strength.

According to a second aspect of the present invention, in the hollow core body for signal transmission cable (100 to 300) according to the first aspect, a compression rate of the compressed bunched conductor is 10% to 30%.

When the compression rate of the compressed bunched conductor is less than 10%, recesses may be produced on the circumferential surface of the compressed bunched conductor, and a sufficient effect may not be obtained. On the other hand, when the compression rate of the compressed bunched conductor is greater than 30%, undesired cutting of the strands (1, 2, 3) may occur frequently. Therefore, it is preferable that the compression rate of the compressed bunched, conductor is 10% to 30%.

According to a third aspect of the present invention, in the hollow core body for signal transmission cable (100 to 300) according to the first aspect or the second aspect, the compressed bunched conductor is formed by compressing a twisted conductor obtained by bunching and twisting plural strands (1, 2, 3).

In the hollow core body for signal transmission cable (100 to 300) according to the third aspect, because a twisted conductor is used, sufficient flexibility and bending property necessary for a coaxial cable can be achieved.

According to a fourth aspect of the present invention, in the hollow core body for signal transmission cable (100 to 300) according to the first aspect or the second aspect, the compressed bunched conductor is formed by compressing a parallel conductor obtained by bunching and bundling plural strands (1, 2, 3) without twisting, and the rib members (22) of the hollow insulating core (20) are not positioned at a boundary between the outermost strands of the compressed bunched conductor.

In the hollow core body for signal transmission cable (100 to 300) according to the fourth aspect, because a parallel conductor is used, it is possible to maintain a positional relationship such that the rib members are not positioned at the boundary between the outermost strands of the compressed bunched conductor. Accordingly, even if recesses are produced at the boundary between the outermost strands of the compressed bunched conductor, because one rib members are not positioned at the recesses, weakening of the mechanical strength can be suppressed.

According to the hollow core body for signal transmission cable (100 to 300) of the present invention, mechanical strength can be improved.

DESCRIPTION OF THE PREFERRED EMBODIMENTS

The present, invention will be explained, in more detail below with reference to the exemplary embodiments shown in the accompanying drawings. However, the present invention is not limited to the embodiments explained below.

Embodiments

First Embodiment

Figure 1:
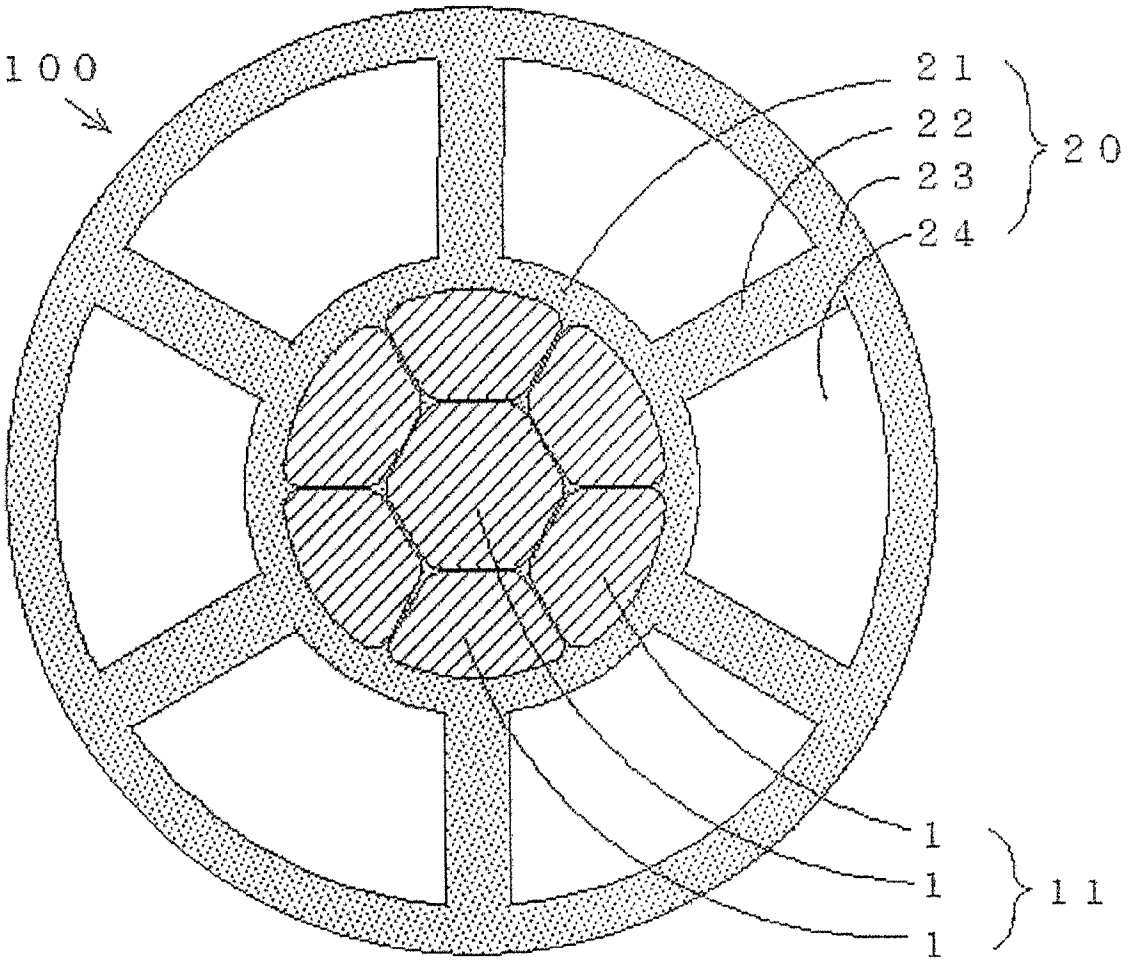
FIG. 1 is a cross-sectional view of a hollow core body for signal transmission cable according to a first embodiment.

FIG. 1 is a cross-sectional view of a hollow core body for signal transmission cable 100 according to a first embodiment.

The hollow core body for signal transmission cable 100 includes an inner conductor 11 and a hollow insulating core 20.

The inner conductor 11 is a compressed bunched conductor that is formed by bunching and twisting seven strands 1, 1, . . . and compressing the strands so that the inner conductor 11 has a substantially circular cross-section.

Bach of the strands 1 is, for example, an annealed copper round wire of a diameter 0.20 millimeter (mm).

A compression, rate of the compressed bunched conductor is, for example, 20%. An outer diameter of the inner conductor 11 is, for example, 0.48 mm. An electric resistance of the inner conductor 11 is, for example, 113.6 Ω/km.

The hollow insulating core 20 includes an inner annular member 21 that covers the inner conductor 11; six rib members 22, 22, . . . that radially extend from the inner annular member 21; an outer annular member 23 that couples outer ends of the rib members 22, 22, . . . ; and six hollow members 24, 24, . . . that are enclosed by the inner annular member 21, the rib members 22, 22, . . . and the outer annular member 23.

A thickness T1 of the thinnest portion of the inner annular member 21 is, for example, 0.03 mm.

Each of the rib members 22 has a rectangular cross-section with a thickness T2 of, for example, 0.075 mm.

A thickness 13 of the outer annular member 23 is, for example, 0.06 mm. An outer diameter of the outer annular member 23 is, for example, 1.17 mm.

That is, a relation T1<T3<T2 is satisfied.

A ratio (i.e., hollowness) of a cross-sectional surface area of the hollow members 24, 24, . . . with respect to a cross-sectional surface area of the hollow insulating core 20 (excluding a cross-sectional surface area of the inner conductor 11) is, for example, 45%.

The hollow insulating core 20 is formed by extrusion molding FEP resin, for example, around the inner conductor 11 that is caused to pass through an extrusion die. The manufacturing speed is, for example, 30 m/min.

An outer conductor is provided around the hollow core body for signal transmission cable 100, and an insulating cover is provided around the outer conductor to obtain a coaxial cable having a characteristic impedance of approximately 50 Ω.

The attenuation of this coaxial cable was 0.77 dB/m (1 GHz, 20° C.).

A lateral pressure was applied on this coaxial cable in a 2-mm-wide area and variation in its characteristic impedance was measured. It was found that the characteristic impedance decreased by 2% for a lateral pressure of 800 grams (g).

Comparative Example

In a comparative example, a twisted conductor formed by bunching and twisting seven strands was used as an inner conductor.

Each strand is, for example, an annealed copper round wire of a diameter 0.16 mm.

An outer diameter of the inner conductor is, for example, 0.48 mm (i.e., the same as that in the first embodiment). An electric resistance of the inner conductor is, for example, 126.6 Ω/km.

A thickness of the thirstiest portion of an inner annular member of a hollow insulating core is, for example, 0.04 mm.

The comparative example has six rib members (i.e., the same number as that in the first embodiment). Each of the rib members has a rectangular cross-section (i.e., the same shape as that in the first embodiment) and a thickness of, for example, 0.065 mm (i.e., thinner than the rib member in the first embodiment).

A thickness of an outer annular member is, for example, 0.06 mm. An outer diameter of the outer annular member is, for example, 1.17 mm (i.e., the same as that in the first embodiment).

A ratio (i.e., hollowness) of a cross-sectional surface area of hollow members with respect to a cross-sectional surface area of a hollow insulating core (excluding a cross-sectional surface area of the inner conductor) is, for example, 45% (i.e., the same as that in the first embodiment).

The hallow insulating core is formed by extrusion molding PEP resin, for example, around the inner conductor that is caused to pass through an extrusion die. The manufacturing speed is, for example, 20 m/min.

An outer conductor is provided around the hollow core body for signal transmission cable, and an insulating cover is provided around the outer conductor to obtain a coaxial cable having a characteristic impedance of about 50 Ω.

The attenuation of this coaxial cable was 0.83 dB/m (1 GHz, 20° C.),

A lateral pressure was applied on this coaxial cable in a 2-mm-wide area and variation in its characteristic impedance was measured. It was found that the characteristic impedance decreased by 2% for a lateral pressure of 700 g.

Thus, the lateral pressure at which the characteristic impedance decreased by 2% is higher for the hollow core body for signal transmission cable 100 according to the first embodiment than for the comparative example, which indicates improvement in the mechanical strength. Moreover, the inner conductor of the hollow core body for signal transmission cable 100 has smaller electrical resistance than that of the comparative example although the outer diameters of both the inner conductors were the same. Furthermore, it was possible to set the manufacturing speed of the hollow core body for signal transmission cable 100 higher than the same for the comparative example. Moreover, the coaxial cable of the first embodiment showed reduced attenuation than the same of the comparative example.

Second Embodiment

Figure 2:
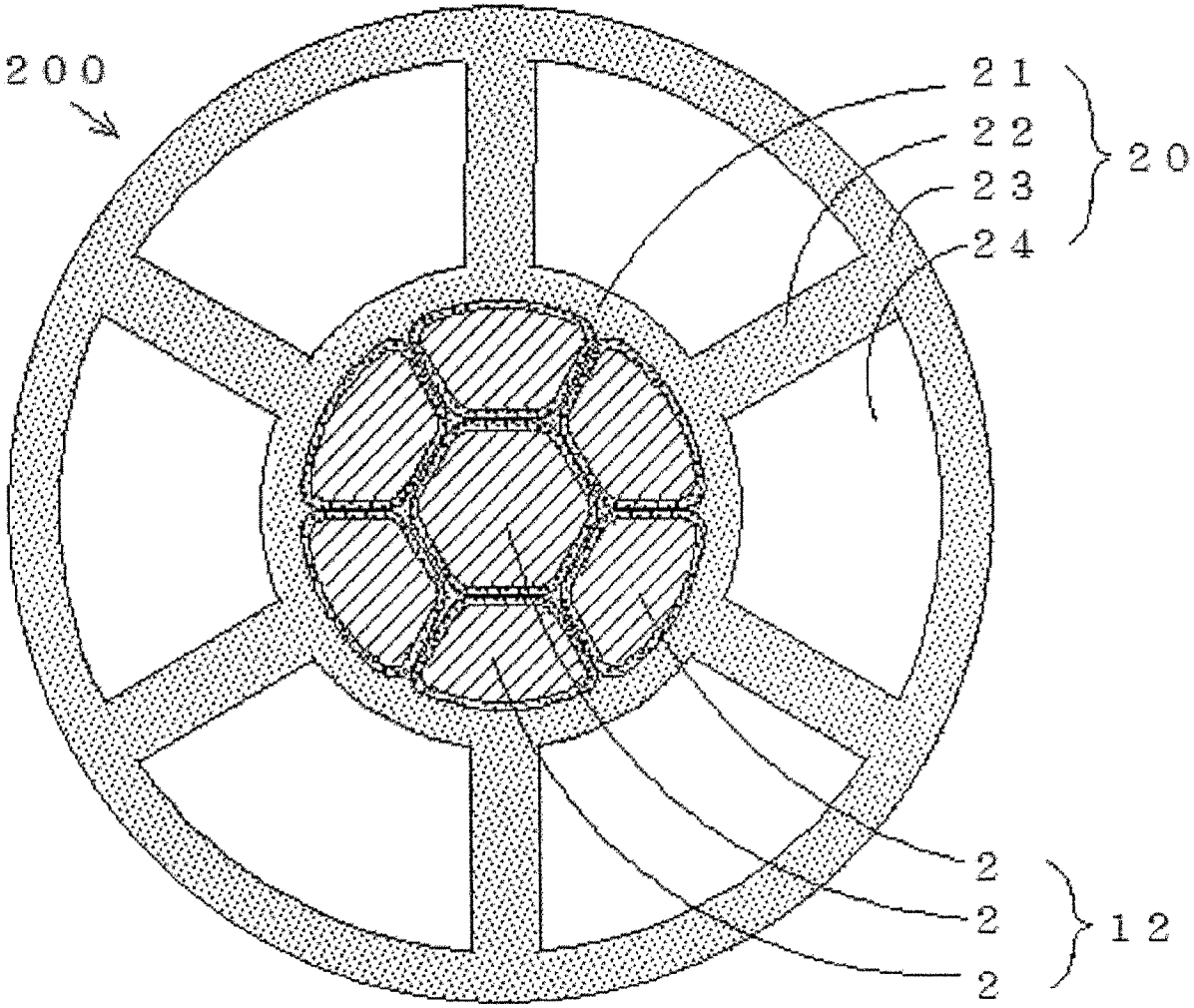
FIG. 2 is a cross-sectional view of a hollow core body for signal transmission cable according to a second embodiment.

FIG. 2 is a cross-sectional view of a hollow core body for signal transmission cable 200 according to a second embodiment.

The hollow core body for signal transmission cable 200 includes, as the inner conductor 12, a compressed bunched conductor that is formed by bunching and twisting six enamel-coated, strands 2, 2, . . . and compressing the strands so that the cross-section of the inner conductor 12 is substantially circular. The rest of the configuration is the same as that of the first embodiment.

Because the strands 2, 2, . . . are coated with enamel, eddy current loss can be suppressed. Accordingly, the hollow core body for signal transmission cable 200 according to the second embodiment is suitable for use in a higher frequency band region as compared to the same according to the first embodiment.

Third Embodiment

Figure 3:
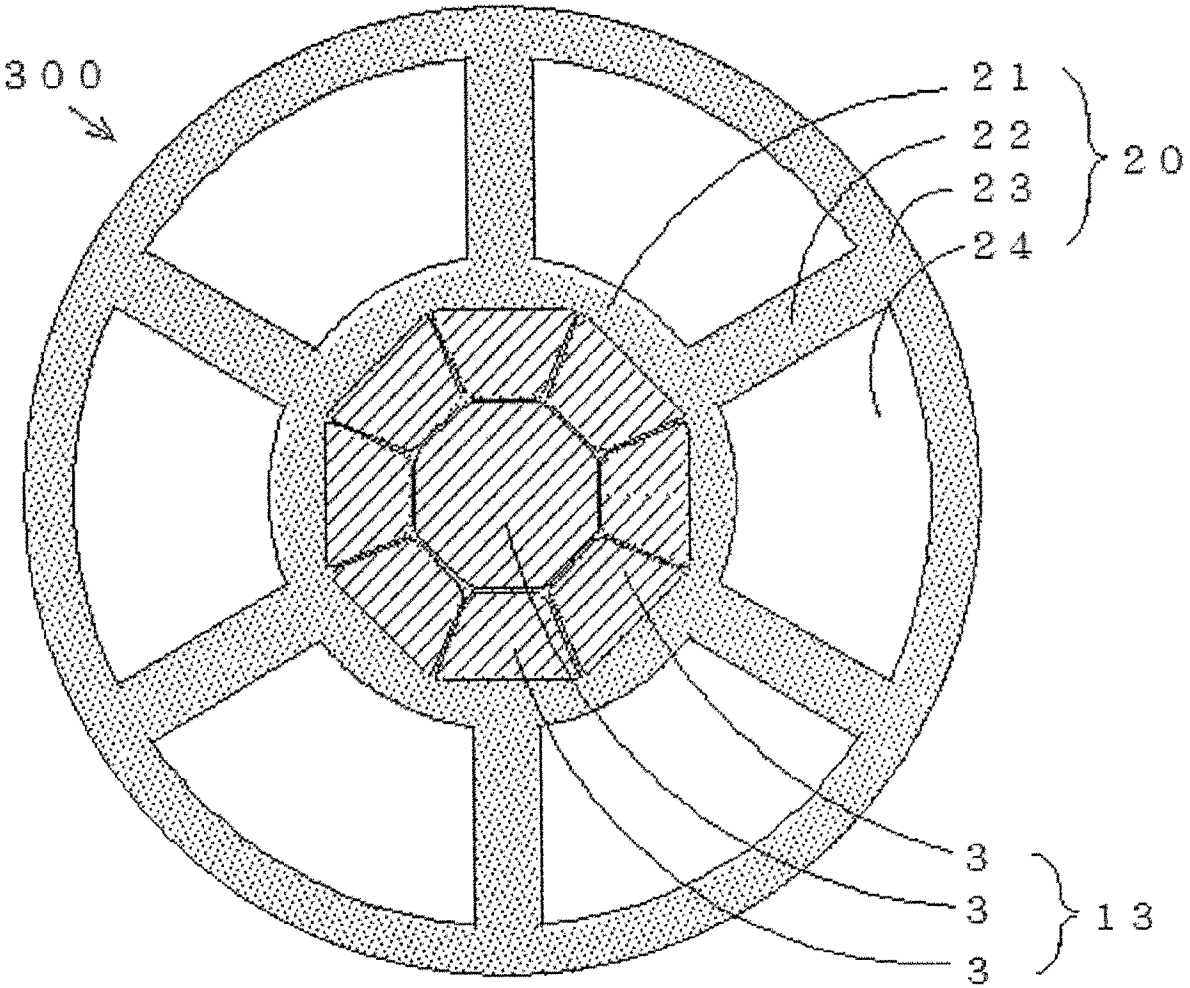
FIG. 3 is a cross-sectional view of a hollow core body for signal transmission cable according to a third embodiment.

FIG. 3 is a cross-sectional view of a hollow core body for signal transmission cable 300 according to a third embodiment.

Figure 4:
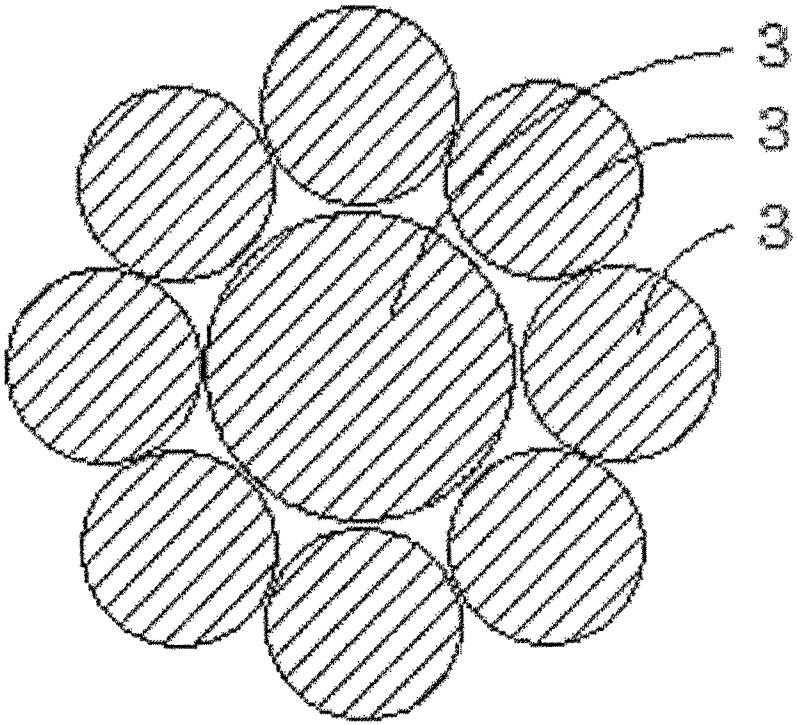
FIG. 4 is a cross-sectional view of a bunched conductor used in the hollow core body for signal transmission cable according to the third embodiment.
Figure 5:
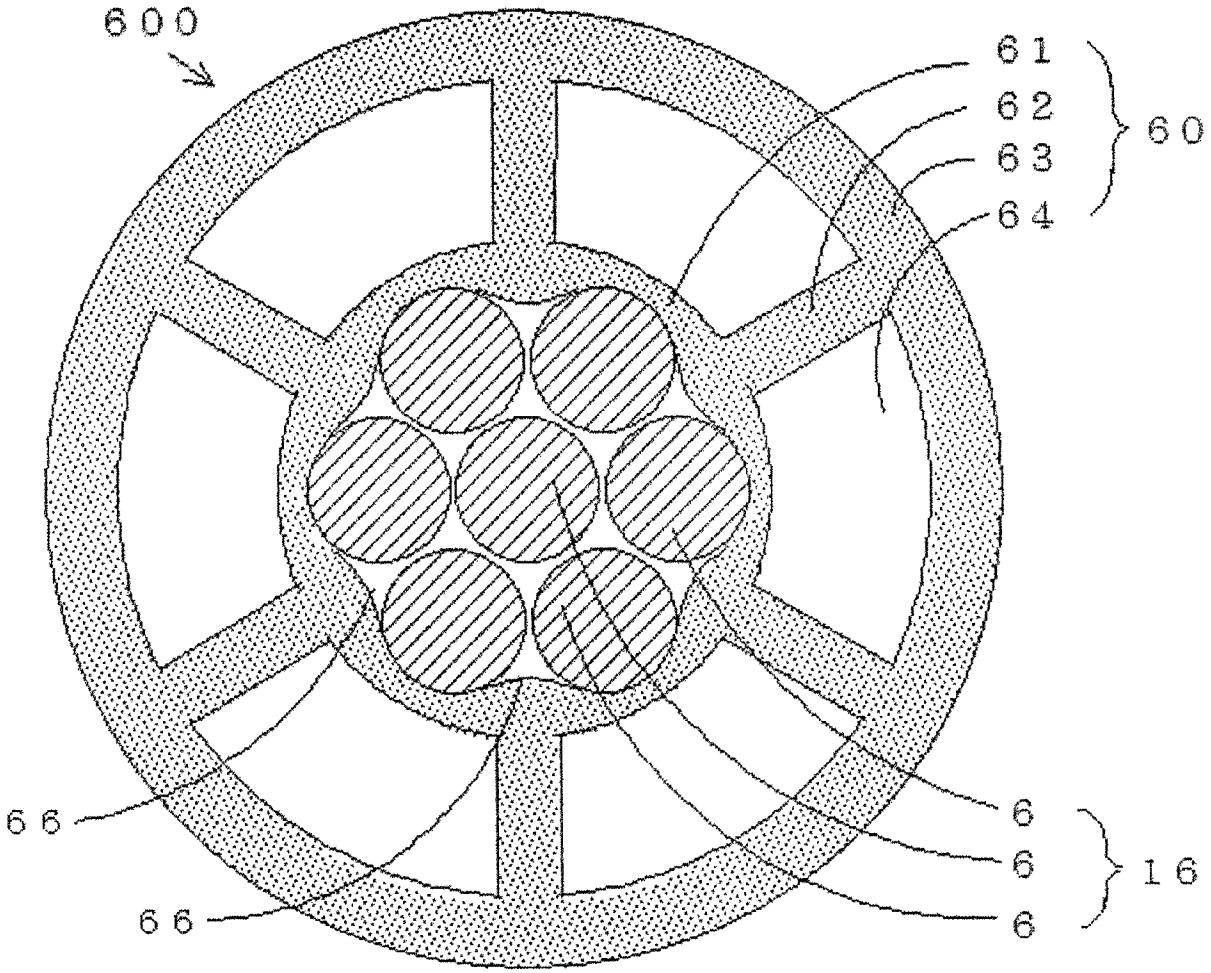
FIG. 5 is a cross-sectional view of a conventional hollow core body for signal transmission cable.
Figure 6:
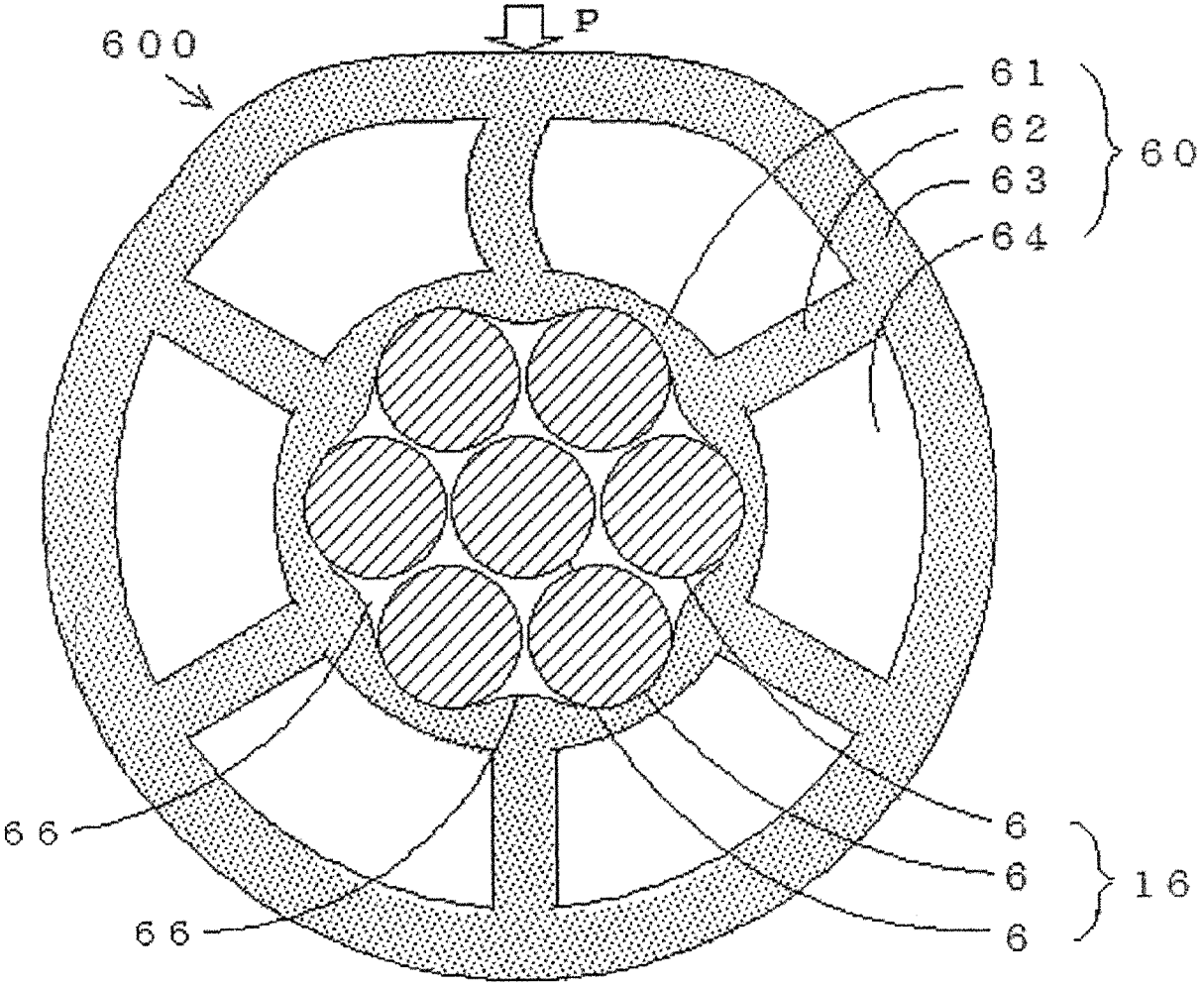
FIG. 6 is a cross-sectional view for explaining how the conventional hollow core body for signal transmission cable deforms when a lateral pressure is applied on it.

The hollow core body for signal transmission cable 300 includes, as the inner conductor 13, a compressed bunched conductor that is formed by bunching and twisting nine copper alloy round wires 3, 3, . . . and compressing the wires so that the cross-section of the inner conductor 13 is substantially octagonal. The rest of the configuration is the same as that of the first embodiment. FIG. 4 is a cross-sectional view of the nine copper alloy round wires 3, 3, . . . before compressing.

The inner conductor 13 is substantially polygonal. The more the number of the angles of the inner conductor 13, the more its cross-section approaches to a circle. Therefore, the more the number of the angles of the inner conductor 13, the more uniform the thickness of the inner annular member 21. Accordingly, it is preferable that the inner conductor 13 has many angles. It may not be preferable to have the number of angles less than the number of the rib members 22, as it makes the thickness of the inner annular member 21 excessively uneven.

Fourth Embodiment

The hollow core bodies for signal transmission cables according to the first embodiment to the third embodiment are formed by bunching and twisting plural strands; however, it is not mandatory to twist the strands. The strands can be bundled parallel, without twisting, and compressed. In this configuration, the hollow insulating core 20 is formed by extrusion molding by arranging the rib members 22 of the hollow insulating core 20 such that the rib members 22 are not positioned at the boundary between the outermost strands of the parallel-compressed bunched conductor.

Because the fourth embodiment employs parallel strands, it is possible to maintain a positional relationship such that the rib members 22 are not positioned at the boundary between the outermost strands of the compressed bunched conductor. Accordingly, even it recesses are produced at the boundary between the outermost strands of the compressed bunched conductor, because the rib members 22 are not positioned at the recesses, weakening of the mechanical strength can be suppressed.

The hollow core body for signal transmission cable according to the present invention can be used as a core body of a coaxial cable for signal transmission.

DESCRIPTION Of REFERENCE NUMERALS

1, 2, 3, 6 Strand
11, 12, 13, 16 Inner conductor
20, 60 Hollow insulating core
21, 61 Inner annular member
22, 62 Rib member
23, 63 Outer annular member
24, 64 Hollow member
66 Recess
100 to 300 Hollow core body for signal transmission cable
P Lateral pressure

The invention claimed is:

1. A hollow core body for signal transmission cable comprising an inner conductor comprised of a bunched conductor formed by bunching plural strands; and a hollow insulating core that includes an inner annular member that surrounds the inner conductor, plural rib members that radially extend from the inner annular member, an outer annular member that couples outer ends of the rib members, and plural hollow spaces that are enclosed by the inner annular member, the rib members, and the outer annular member, wherein the inner conductor is a compressed bunched conductor configured so as to suppress formation of a recesses on the circumferential surface of the compressed bunched conductor, thereby improving evenness of the thickness of the inner annular member, by being formed by bunching plural strands and compressing the bunched strands such that a cross-section of the compressed assembly is substantially circular or substantially polygonal having a number of angles the same as or larger than a number of the rib members, and wherein a relation between a first thickness (T1) of a thinnest portion of the inner annular member, a second thickness (T2) of the rib members, and a third thickness (T3) of the outer annular member is $T1<T3<T2$.

2. The hollow core body for signal transmission cable according to claim 1, wherein a compression rate of the compressed bunched conductor is 10% to 30%.

3. The hollow core body for signal transmission cable according to claim 2, wherein the compressed bunched conductor is formed by compressing a twisted conductor obtained by bunching and twisting plural strands.

4. The hollow core body for signal transmission cable according to claim 1, wherein the compressed bunched conductor is formed by compressing a twisted conductor obtained by bunching and twisting plural strands.

5. A hollow core body for signal transmission cable comprising an inner conductor comprised of a bunched conductor formed by bunching plural strands; and a hollow insulating core that includes an inner annular member that surrounds the inner conductor, plural rib members that radially extend from the inner annular member, an outer annular member that couples outer ends of the rib members, and plural hollow spaces that are enclosed by the inner annular member, the rib members, and the outer annular member, wherein the inner conductor is a compressed bunched conductor formed by bunching plural strands and compressing the bunched strands such that a cross-section of the compressed assembly is substantially circular or substantially polygonal having a number of angles the same as or larger than a number of the rib members, and wherein the compressed bunched conductor is formed by compressing a parallel conductor obtained by bunching and bundling plural stands without twisting, and the rib members of the hollow insulating core are not positioned at a boundary between the outermost strands of the compressed bunched conductor.

6. A hollow core body for signal transmission cable comprising an inner conductor comprised of a bunched conductor formed by bunching plural strands; and a hollow insulating core that includes an inner annular member that surrounds the inner conductor, plural rib members that radially extend from the inner annular member, an outer annular member that couples outer ends of the rib members, and plural hollow spaces that are enclosed by the inner annular member, the rib members, and the outer annular member, wherein the inner conductor is a compressed bunched conductor formed by bunching plural strands and compressing the bunched strands such that a cross-section of the compressed assembly is substantially circular or substantially polygonal having a number of angles the same as or larger than a number of the rib members, wherein a compression rate of the compressed bunched conductor is 10% to 30%, and wherein the compressed bunched conductor is formed by compressing a parallel conductor obtained by bunching and bundling plural stands without twisting, and the rib members of the hollow insulating core are not positioned at a boundary between the outermost strands of the compressed bunched conductor.

* * * * *